US009251673B2

(12) United States Patent
Todd

(10) Patent No.: US 9,251,673 B2
(45) Date of Patent: Feb. 2, 2016

(54) SECURITY ASSEMBLY AND METHOD OF CONTROLLING A SECURITY ASSEMBLY

(75) Inventor: Robert Edmund Todd, Cramlington (GB)

(73) Assignee: CEDARDELL LIMITED, Milton Keynes (GB)

( * ) Notice: Subject to any disclaimer, the term of this patent is extended or adjusted under 35 U.S.C. 154(b) by 0 days.

(21) Appl. No.: 13/457,374

(22) Filed: Apr. 26, 2012

(65) Prior Publication Data

US 2012/0204772 A1 Aug. 16, 2012

Related U.S. Application Data

(62) Division of application No. 12/602,645, filed as application No. PCT/GB2008/001725 on May 20, 2008.

(30) Foreign Application Priority Data

Jun. 1, 2007 (GB) ..... 0710395.5

(51) Int. Cl.

| | |
|---|---|
| ***E05G 1/08*** | (2006.01) |
| ***G07F 19/00*** | (2006.01) |
| ***E05B 65/00*** | (2006.01) |

(52) U.S. Cl.

CPC ..... *G07F 19/205* (2013.01); *E05B 65/0075* (2013.01); *E05G 1/08* (2013.01); *G07F 19/20* (2013.01); *Y10T 70/5111* (2015.04); *Y10T 70/5115* (2015.04); *Y10T 70/7921* (2015.04); *Y10T 70/7927* (2015.04); *Y10T 292/18* (2015.04)

(58) Field of Classification Search

CPC ..... G07F 19/025; G07F 19/20; E05G 1/08; Y10T 70/7927; Y10T 70/5111; Y10T 70/5115; Y10T 70/7921; Y10T 292/18; E05B 65/0075

USPC ..... 70/267–270, 271–274, 278.7; 109/47, 109/53, 54, 56, 57, 59 R, 59 T, 68; 312/215, 312/222

See application file for complete search history.

(56) References Cited

U.S. PATENT DOCUMENTS

| | | | | |
|---|---|---|---|---|
| 3,261,050 | A * | 7/1966 | Caille et al. | 15/311 |
| 3,886,953 | A * | 6/1975 | Pope | 131/270 |
| 4,649,833 | A * | 3/1987 | Cummins | 109/25 |
| 5,979,198 | A * | 11/1999 | Haas-Trober et al. | 70/268 |
| 7,464,570 | B1 * | 12/2008 | Chen | 70/267 |
| 8,443,737 | B2 * | 5/2013 | Todd | 109/59 R |
| 2003/0230124 | A1 * | 12/2003 | Johnson et al. | 70/267 |

FOREIGN PATENT DOCUMENTS

| | | | |
|---|---|---|---|
| GB | 1402448 | * | 8/1975 |

* cited by examiner

*Primary Examiner* — Lloyd Gall
(74) *Attorney, Agent, or Firm* — Zilka-Kotab, PC

(57) ABSTRACT

A method of controlling a security assembly comprising a frame member and at least one door is disclosed. The method comprises the step of when a door is required to be opened, determining whether the door has been open within a predetermined past time period, such as the past hour. If the door has not been open the predetermined past time period, the door is allowed to be opened. However, if the door has been open during the predetermined past time period, the door is not allowed to be opened.

5 Claims, 11 Drawing Sheets

SECURITY ASSEMBLY AND METHOD OF CONTROLLING A SECURITY ASSEMBLY

The present invention relates to a security assembly for protecting valuables. The present invention also relates to a method of controlling a security assembly comprising a frame member and at least one door, and relates to a control apparatus for controlling a security assembly comprising a frame member and at least one door.

Automated Teller Machines (ATMs) generally comprise a front having a key pad, card slot, screen and cash dispenser. The rear of an ATM comprises a rack having a plurality of slots in which removable cash cassettes are mounted in order to supply the ATM with cash. The cash cassettes are generally protected by one or more reinforced doors. This type of ATM suffers from the drawback that if a person gains access through the rear doors of the ATM, then they can access all of the cash cassettes. Safes can suffer from the same problems. If the outer door of a safe is breached, access is gained to the contents of the safe.

GB2363426 describes an apparatus for preventing removal of cash cassettes from an ATM comprising a plurality of locking bars, wherein each cassette has a respective locking bar and each locking bar is individually lockable. This means that removal of a locking bar only permits access to a single cash cassette, rather than all of the cassettes.

The apparatus of GB2363426 suffers from the drawback that the locking bars only extend across a portion of the cash cassette which means that the cash cassettes are vulnerable to being cut open through the gaps between the locking bars to allow removal of cash. The apparatus of GB2363426 also suffers from the drawback that in one of the embodiments, the locking bars are completely removable which means that attackers can potentially use the locking bars as weapons against security staff who are refilling the ATM.

A preferred embodiment of the present invention seeks to overcome the above disadvantages of the prior art.

According to the present invention, there is provided a security assembly comprising:

a frame member;

at least one door mounted to the frame member and moveable between an open condition permitting access through at least one said door and a closed condition preventing access through at least one said door; and at least one barrier member arranged to extend across substantially the whole of a gap between one side of the periphery of the door and a frame member or further door facing said side of the periphery of said door to prevent access through said gap.

This provides the advantage of making it difficult for a potential attacker to break in to the assembly. The barrier member prevents access through a gap between the door and the frame or an adjacent door which means that it is difficult to gain purchase on the assembly with attack tools such as a crow bar to lever the assembly apart.

In a preferred embodiment, the assembly further comprises a plurality of barrier members arranged to extend around substantially the whole length of the periphery of the or each said door to prevent access through the gap defined by the periphery of the or each said door.

This provides the advantage of further increasing the difficulty of gaining access through the door because all sides of the door will have to be successfully attacked in order to be able to remove the door.

In a preferred embodiment, the or each said barrier member is supported by the frame member or at least one said door and has a locked condition in which the barrier member is slidably received in at least one engaging member disposed on the other of at least one said door and the frame member in order to lock the door in said closed condition.

At least one said engaging member may comprise a recess formed in at least one said door or frame member.

This provides the advantage that if the door is attacked and loosened from its mountings, for example if the hinges are smashed, then the door will simply slide around by virtue of the barrier members being slidably received in the surrounding recesses which will still prevent access through the door. This also therefore provides the advantage that because the loosened doors are moveable, it is more difficult to wedge a tool such as a crowbar against the doors or frame in order to gain access because the doors may move when a force is exerted meaning that the tool will slip.

The assembly may further comprise at least one barrier member actuator, the or each said barrier member actuator having a locked condition in which said barrier member actuator engages at least one said barrier member to move the or each said barrier member into the locked condition.

This provides the advantage of a relatively simple mechanism for moving all of the barrier members into the locked condition.

In a preferred embodiment, said barrier member actuator extends across a gap defined by one side of the periphery of at least one said door to prevent access through said gap when in the locking condition.

This provides the advantage that the barrier member actuator also helps to prevent access through the security assembly.

The assembly may further comprise biasing means adapted to return at least one said barrier member into an unlocked condition when said barrier member actuator is retracted from the locking condition.

At least one said door may be formed from a plurality of sheets of material in a laminated structure.

This provides the advantage of producing a relatively strong structure.

In a preferred embodiment, a first sheet of material may be formed from a different material than a second sheet of material.

This provides the advantage that if gas or heat cutting is attempted to attack the assembly, noxious reactive gases may be produced by attempting to burn two different materials with a common and confined flame. For example, if the laminated structure comprises a layer of bright mild steel and a layer of stainless steel, noxious gases will be produced as a result of burning making cutting dangerous. It will also be more difficult to cut through the door because the two materials melt and burn differently which will increase the time taken to attack the assembly.

The or each said barrier member may be formed from a third sheet of material.

This provides the advantage that the barrier members form part of the laminated structure of the door, which increases the strength of the door. Generally, the presence of a lock will weaken a door. However, the laminated structure of the door and barrier members creates a door that is effectively a single sheet of material to eliminate weak points.

According to another aspect of the present invention, there is provided a method of controlling a security assembly comprising a frame member and at least one door, the method comprising the steps of:

when at least one said door is required to move from a closed condition to an open condition, determining whether said door has been in the open condition within a predetermined first past time period;

if said door has not been in the open condition during said predetermined past first time period, allowing the door to be opened; or if said door has been in the open condition during said predetermined past first time period, retaining said door in the closed condition.

In the case of an ATM, thieves will generally wait until security staff refilling the ATM have nearly completed the refill before attempting to rob the ATM. This means that more cash will be available for the attackers because the ATM will be nearly full. Consequently, by providing a method in which it is determined whether a door of a security assembly has been in the open condition within a predetermined first past time period, for example the past hour, and if the door has been open in that period then retaining the door in the closed condition, this provides the advantage that if a cash cassette has been refilled and the associated door closed then access will be prevented to that cash cassette for an hour after it has been refilled. This means that it will be more difficult for thieves to access the cash, and also means that thieves will be deterred from attempting to rob the ATM which is being protected because they will know that only a limited amount of cash will be easily available.

In a preferred embodiment, the method further comprises the step of if said door has not been in the open condition during said predetermined past first time period, awaiting the end of a predetermined second time period and then allowing the door to be opened.

Awaiting the end of a predetermined second time period, for example waiting 30 seconds, and then opening the door provides the advantage of a further deterrent for thieves because the time is increased for thieves to gain access to valuables. For example, if an ATM is being attacked and the ATM has four cash cassettes, then a total time period of two minutes will be added to the time taken to open all four doors protecting the cash cassettes. If thieves have broken into a bank then the alarm system of the bank will generally already have been activated. Consequently, an addition of two minutes for thieves working under an alarm condition will act as a major deterrent.

According to a further aspect of the present invention, there is provided a control apparatus for controlling a security assembly comprising a frame member and at least one door, the apparatus comprising control means adapted to use the method as defined above.

The security assembly may comprise a plurality of doors and each said door may comprise a respective access switch, and wherein closing an access switch indicates to the control apparatus that the corresponding door is required to move from a closed condition to an open condition.

In a preferred embodiment, the apparatus has an inactive condition in which each said door cannot be opened and an active condition in which the doors can be opened, and wherein the active condition is activated by closing the access switches in a predetermined sequence.

This provides the advantage that the control apparatus can be activated without any dedicated keys or other controls. This provides a concealed method of activating the security assembly because the switches or buttons that are used to open the doors also act to activate the assembly.

A preferred embodiment of the present invention will now be described, by way of example only and not in any limitative sense, with reference to the accompanying drawings in which:—

Figure 1:
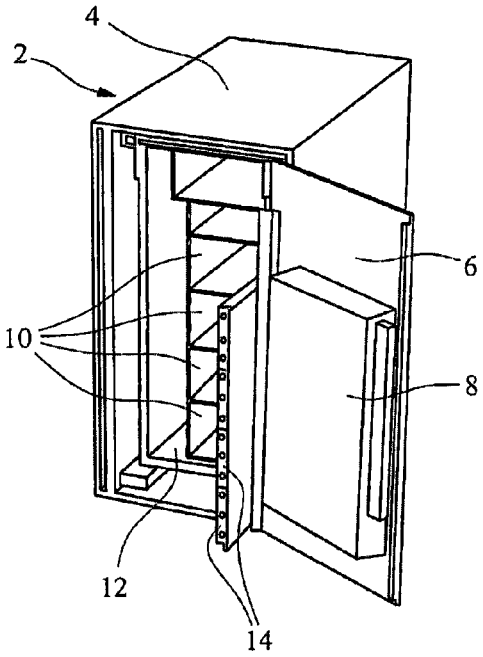
FIG. 1 is a rear view of an ATM in which a security assembly embodying the present invention is shown with the doors of the security assembly in the open condition.
Figure 2:
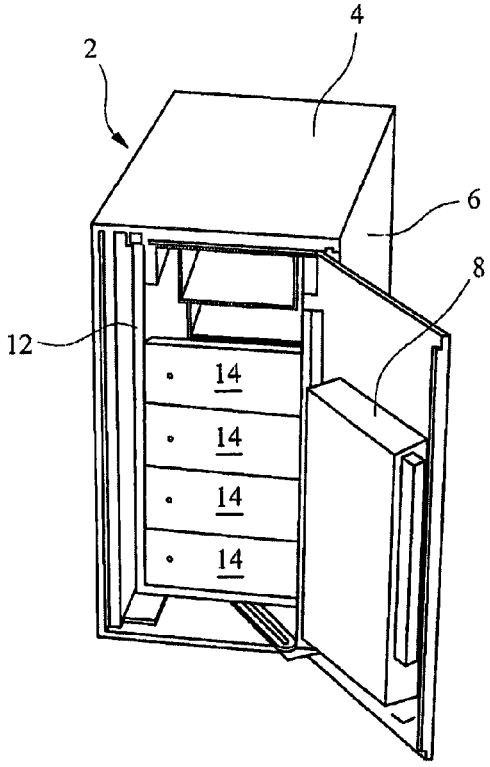
FIG. 2 is a rear view of an ATM corresponding to FIG. 1 with the doors of the security assembly shown in the closed condition.
Figure 3:
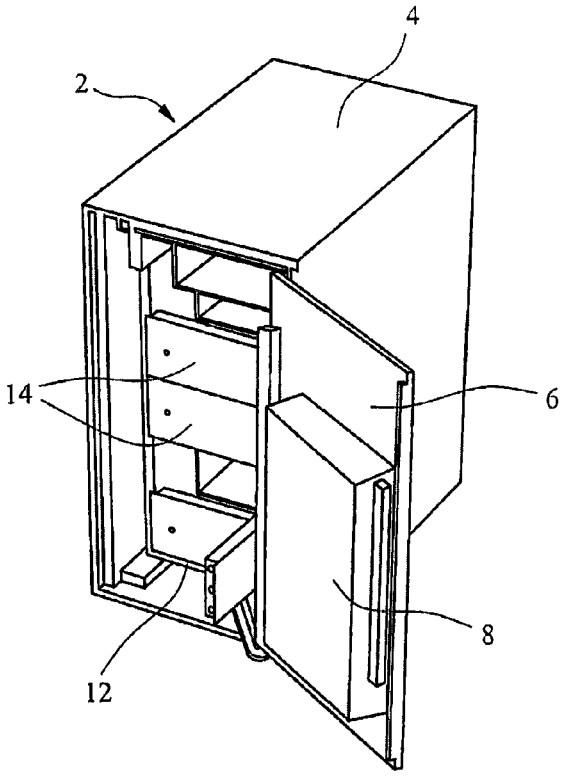
FIG. 3 is a rear view of an ATM corresponding to FIGS. 1 and 2 with one door of the security assembly shown in the open condition.

Referring to FIGS. 1 to 3, an ATM 2 comprises a housing 4 and a reinforced outer door 6 having a locking mechanism 8. The ATM 2 comprises four cash compartments 10 (FIG. 1) in which cash cassettes (not shown) containing bank notes can be mounted in order to supply the ATM 2 with cash to be dispensed. A security assembly comprising a frame member 12 and a plurality of doors 14 is mountable inside the housing 4 of ATM 2. The security assembly can be welded to the inside of the ATM.

FIG. 1 shows all of the doors 14 in the open condition permitting access to all of the compartments for holding cash cassettes (not shown). FIG. 2 shows all of the doors 14 in the locked condition preventing access to compartments 10 and FIG. 3 shows one of doors 14 in the open condition allowing access to one of the compartments 10. Each of doors 14 is independently lockable to permit access to only one compartment 10 at a time such that if service personnel who refill ATM 2 are attacked, then the attacker will only initially be able to access a single compartment 10 and therefore a single cash cassette, which will increase the time taken for the thief to gain access to the further cash cassette and act as a deterrent.

Figure 4:
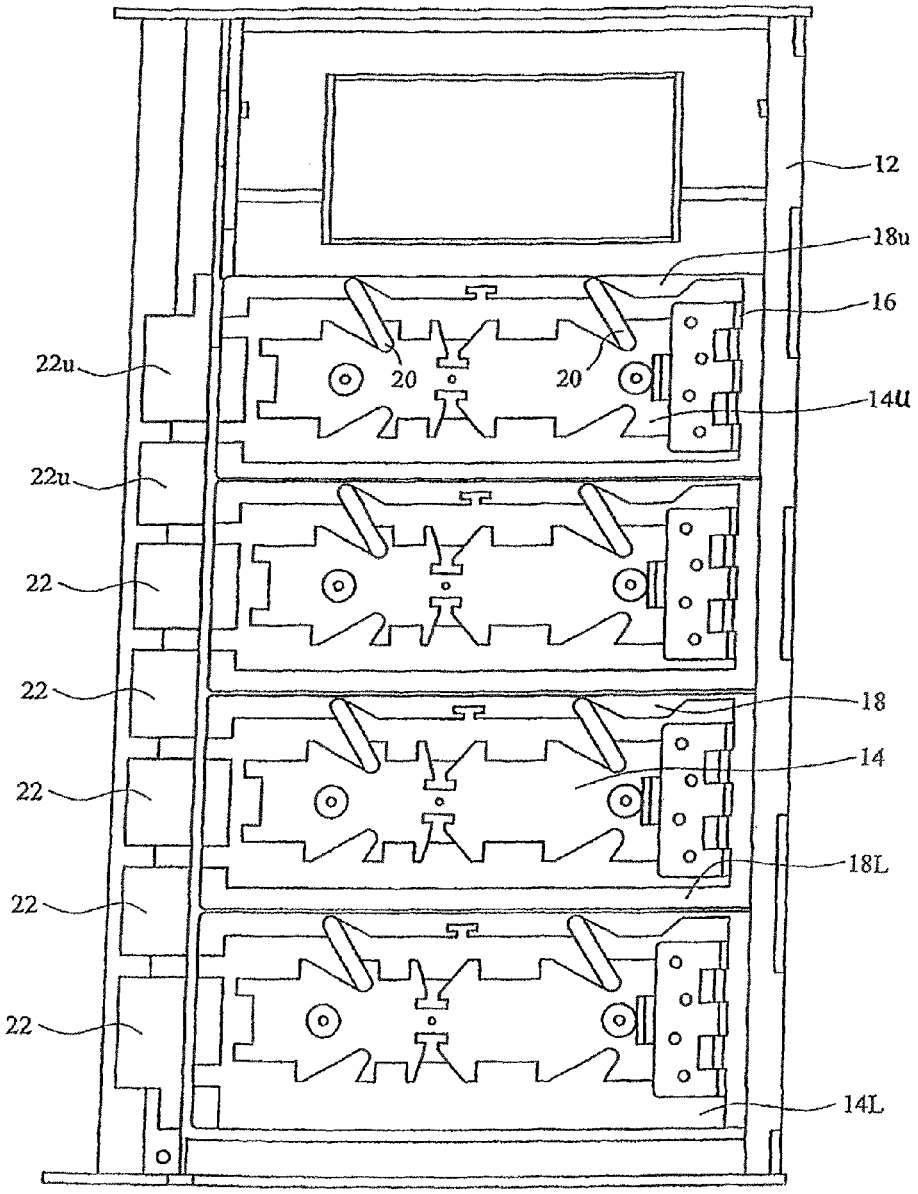
FIG. 4 is a rear view of the security assembly shown in partial cross-section.
Figure 5:
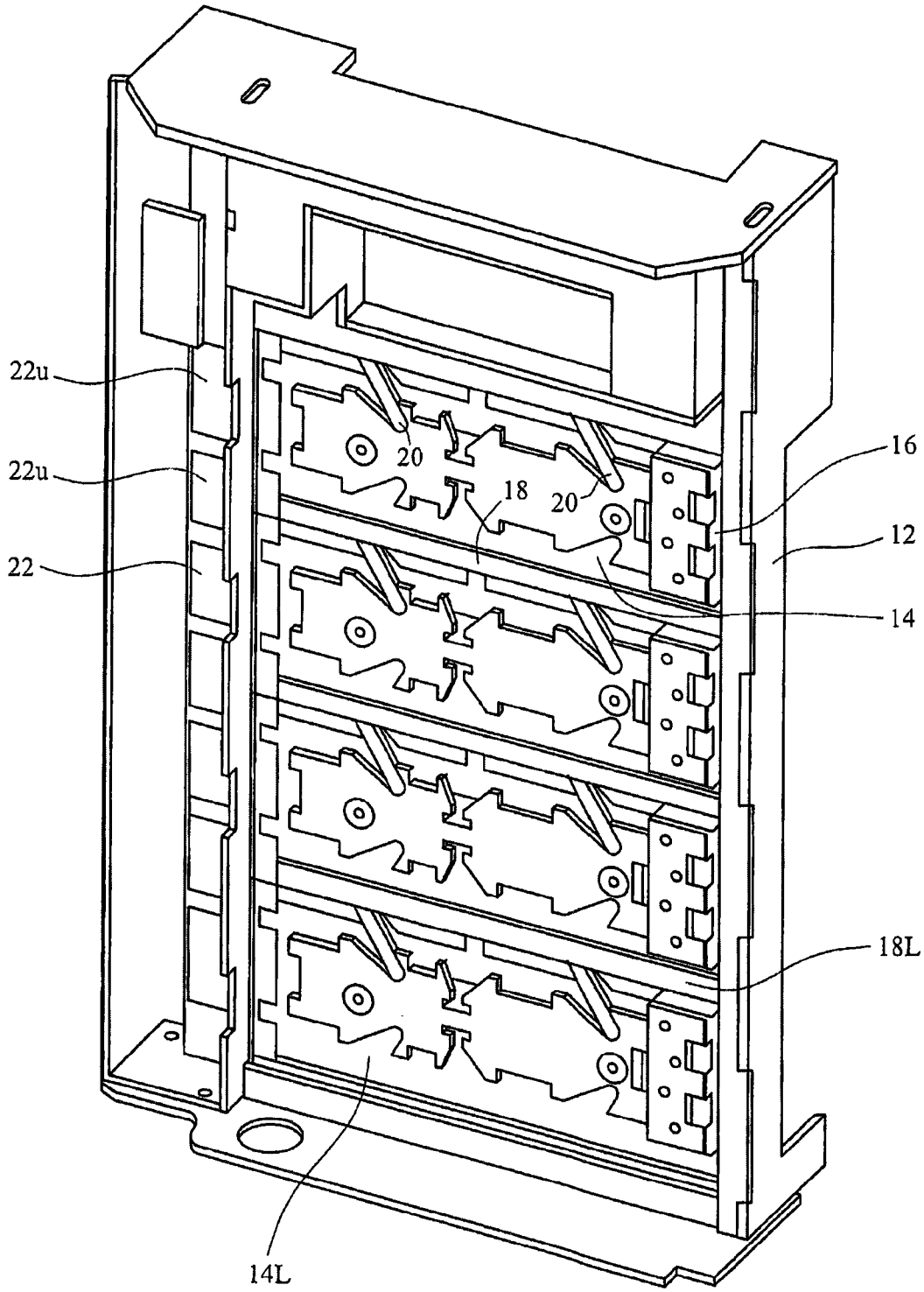
FIG. 5 is a perspective view from the rear of the security assembly corresponding to FIG. 4.

Referring to FIGS. 4 and 5, each door 14 is attached to the frame member 12 by a hinge 16. A barrier member 18 which acts to lock the door 14 is mounted to the door 14 by two pivoting brackets 20. When in the locked condition, the barrier members 18 extend substantially along the whole length of one or more sides of the periphery of the door to prevent access through the gaps between the periphery of the doors and the frame. The barrier members in the locked condition are received in an engaging member such as a recess in the adjacent door or portion of frame. Alternatively, the engaging member may be a bracket (not shown) attached to an adjacent door or portion of frame.

A barrier member actuator in the form of a plurality of independently moveable locking blades 22 is slidably mounted to the frame 12, the locking blades 22 being actuated by drive means (not shown) which move the locking blades 22 from a leftward retracted condition to a rightward locking condition. FIGS. 4 and 5 show the locking blades in the locking condition. The locking blades 22 prevent access through the boundary between the frame and the doors.

Figure 10:
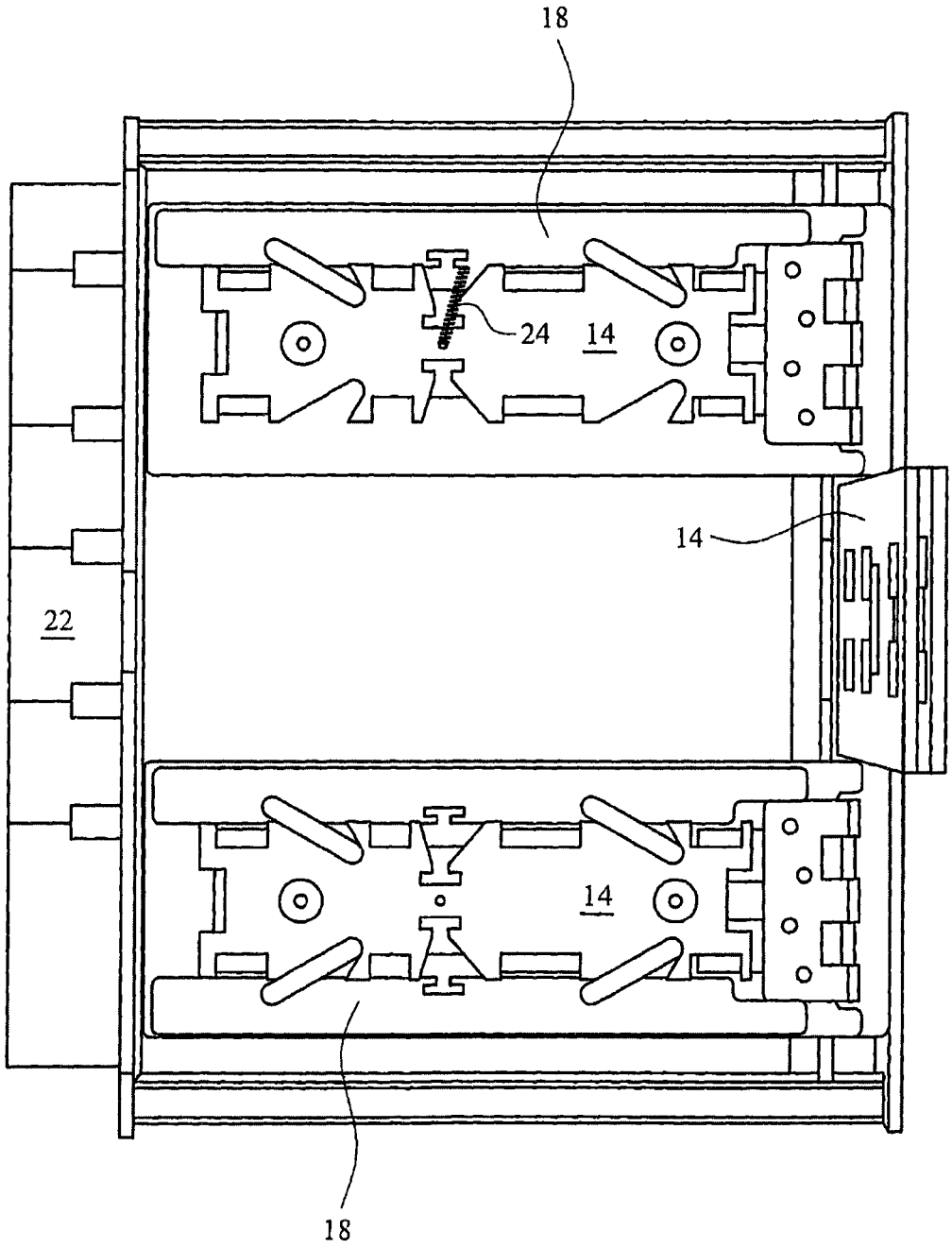
FIG. 10 is a rear view in partial cross-section of a security assembly with all of the barrier members in the unlocked condition and one of the doors open.

It should be understood that lower door 14L will also generally have a lower barrier member (not shown) that can be received in a corresponding recess formed in the lower part of the frame. Such a lower barrier member is shown in FIG. 10.

Figure 6:
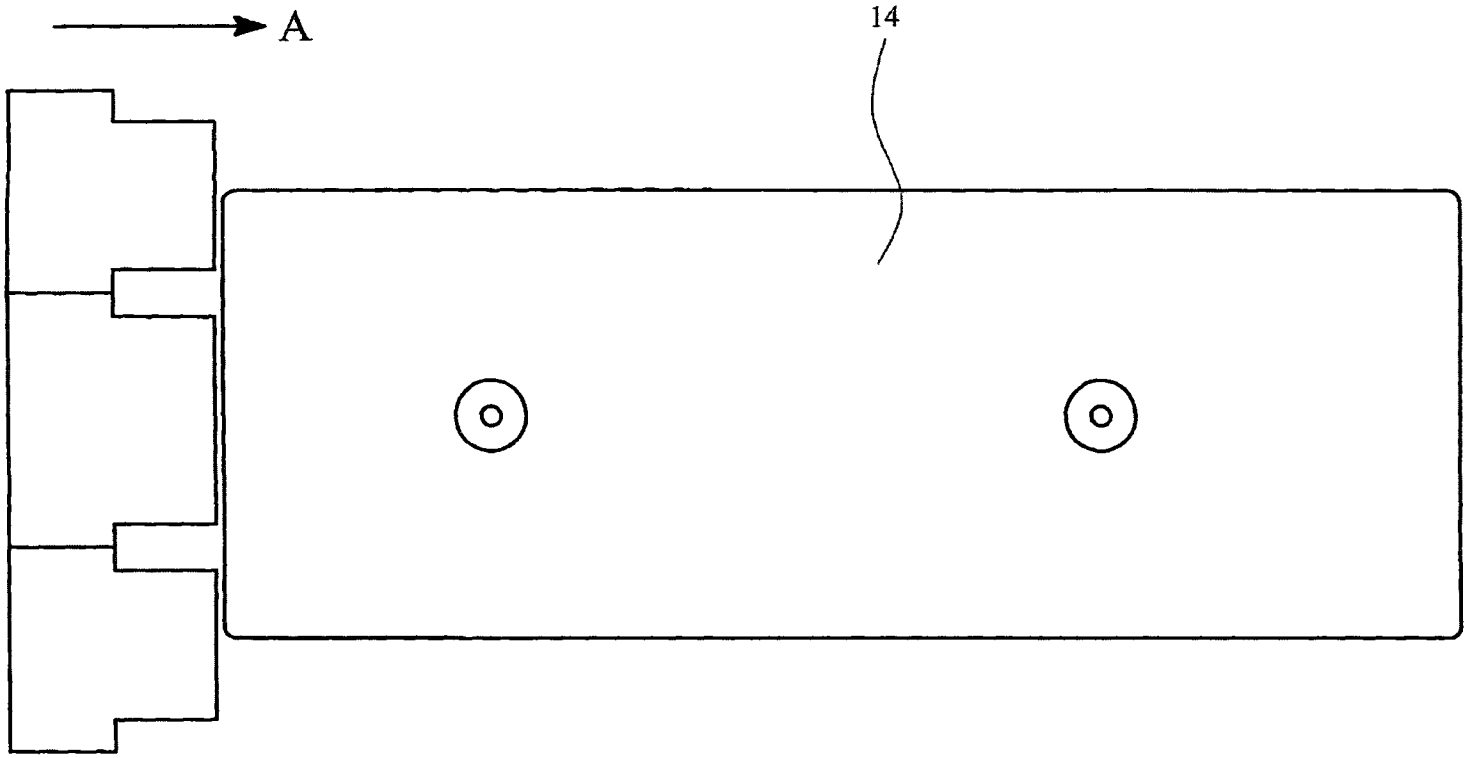
FIG. 6 is a front view of one of the doors of the security assembly of FIGS. 1 to 5 shown with the three locking blades in the retracted condition.

Referring to FIG. 6, in order to lock door 14, each of the locking blades 22 associated with door 14 are moved rightwardly in the direction of arrow A into the locking condition. It should be understood that each locking blade 22 is moveable independently of the other locking blades in order to allow each individual door 14 to be independently lockable as will be described below.

Figure 7:
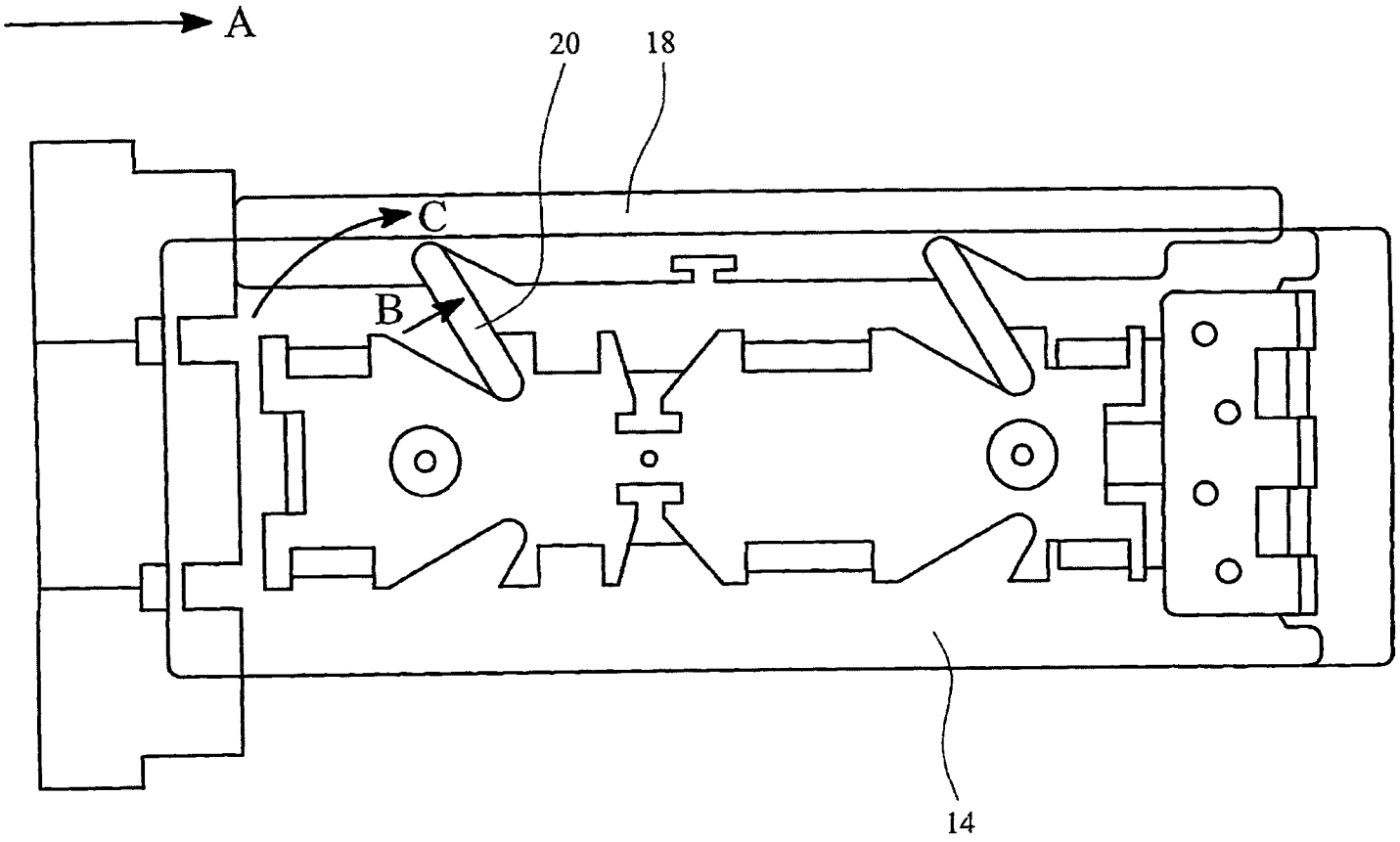
FIG. 7 is a partial cross-sectional view from the front of the door of FIG. 6 with the locking blades shown in the locking condition.

Referring to FIG. 7, as the locking blades 22 move in the direction of arrow A into the locking condition, the uppermost locking blade 22 abuts the left hand edge of barrier member 18 causing mounting bracket 20 to pivot in the direction of arrow B and barrier member 18 to move in the direction of arrow C into the locked condition. In the locked condition, barrier member 18 projects into a recess (not shown) formed in one of the other doors 14 or in the frame member in order to lock the door 14 in the closed condition preventing access to the cash container in front of which the door 14 is located. A return spring 24 (FIG. 10) is provided to return the barrier member 18 into the unlocked condition when the locking blades 22 are retracted. Door 14 may also have a lower barrier member (not shown) which can be actuated by the lowermost blade 22.

Figure 8:
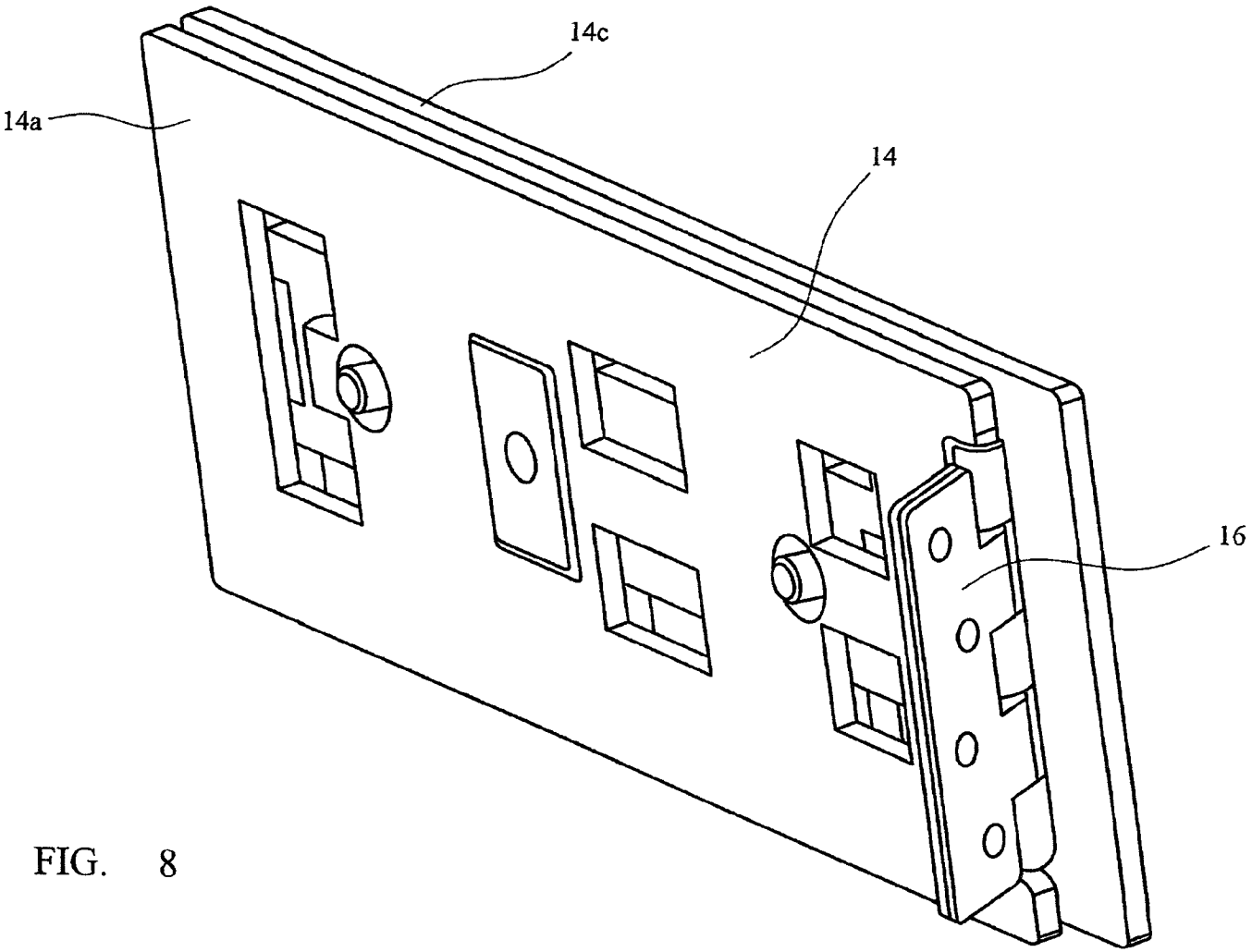
FIG. 8 is a rear perspective view of one of the doors of the security assembly.
Figure 9:
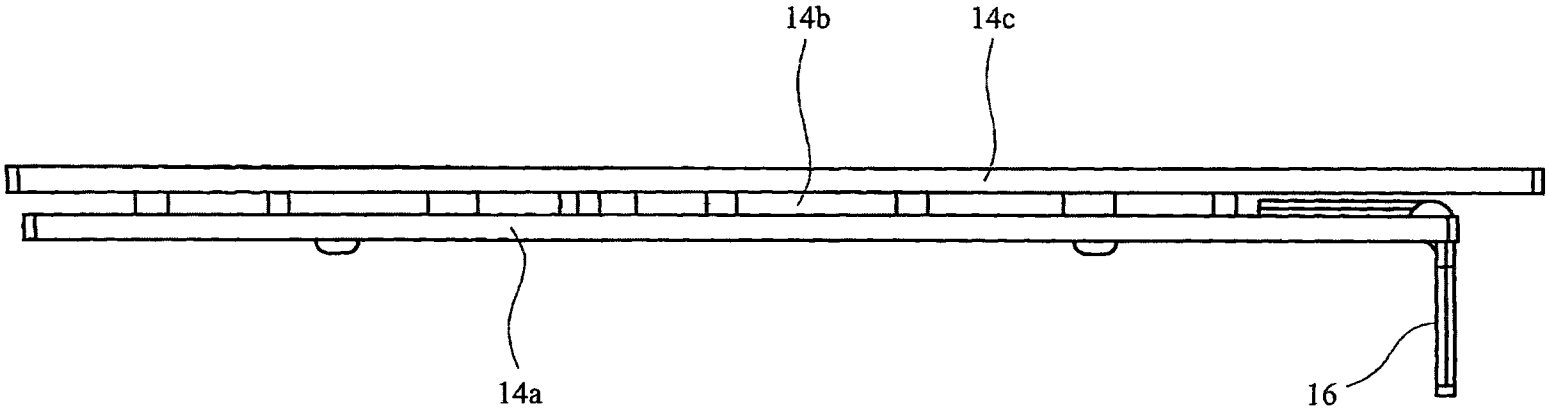
FIG. 9 is a view from the top of the door of FIG. 8.

Referring to FIGS. 8 and 9, each door is formed from 3 layers of material 14*a*, 14*b* and 14*c*. The layers may be metal and each layer 14*a* to 14*c* may be formed from a different type of metal. For example, layers 14*a* and 14*c* can be formed from bright mild steel and layer 14*b* can be formed from stainless steel. Also, barrier members 18 can be formed a sheet of material such as metal which can be different to the metals used to form sheets 14*a*, 14*b* and 14*c*. This means that if the security assembly is subject to attack by gas or heat cutting then attempting to burn these two materials with a common and confined flame can product noxious reactive gases which make a heat cutting attack dangerous. Trying to burn through two different materials also increases the time it will take to burn through the security assembly. It can also be seen in FIG. 9 that layer 14*b* is recessed from layers 14*a* and 14*c* to form a recess in which the barrier member 18 is slidably received in order to lock two doors together or lock a door to the frame.

Forming barrier members 18 from a sheet of material means that the barrier members 18 form part of the laminated structure of the door 14 which increases the strength of the door. Generally, the presence of a lock will weaken a door. However, the laminated structure of the door 14 and barrier members 18 creates a door that is effectively a single sheet of material to eliminate weak points.

Figure 11:
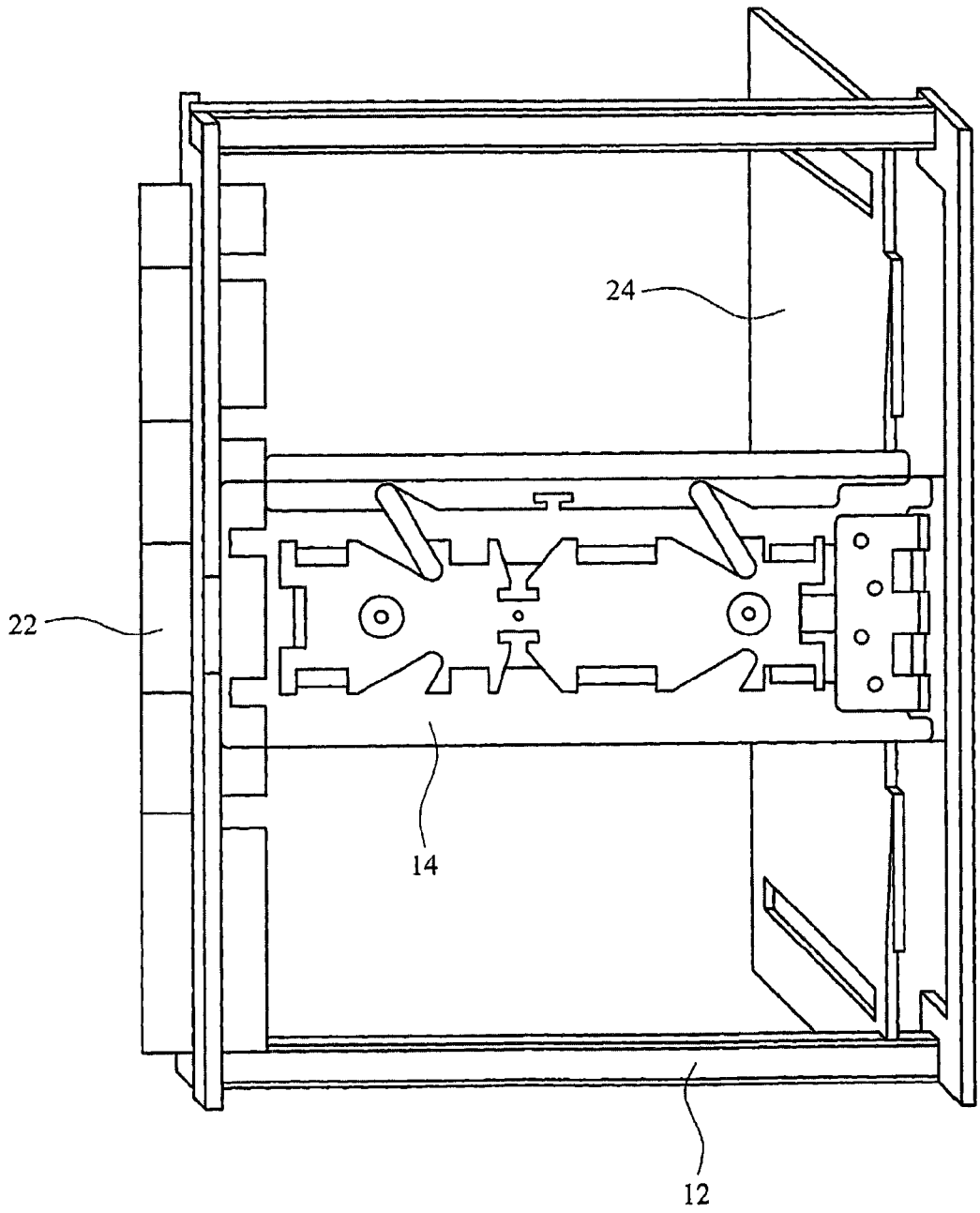
FIG. 11 is a rear view of the security assembly of FIG. 10 with two of the doors removed for clarity showing a blocking member for preventing the doors being forced inwardly.

Referring to FIG. 11, a blocking member 24 can be provided behind the security assembly in order to prevent doors 14 being forced inwardly.

Referring to FIGS. 4 and 5, the operation of the security assembly will now be described. Each door 14 has at least two locking blades 22 and a barrier member 18 associated with it. For example, the upper door 14*u* shown in FIG. 4 has locking blades 22*u* and barrier member 18*u* associated with it. Locking blades 22*u* are independently moveable of each other and all of the other locking blades 22 disposed along the frame 12. The barrier members 18 can either be disposed in a recess formed in an adjacent door or be disposed in a recess formed in the frame when in the locked condition. For example, the barrier member 18*u* of upper door 14*u* is received in a recess (not shown) formed in frame 12, whereas the barrier member 18L of the lower door 14L is disposed in a recess (not shown) received in the door 14 above lower door 14L. It should be understood that lower door 14L would also generally have a lower barrier member (not shown) that can be received in a corresponding recess formed in the lower part of the frame. Such a lower barrier member is shown in FIG. 10.

If service personnel require access to the uppermost cash cassette of the ATM, then locking blades 22*u* are retracted which releases barrier member 18*u* from the locked condition allowing upper door 14*u* to be opened. However, the remaining barrier members 22 are not retracted which means that the remaining doors 14 are still locked. Further barrier members can be provided on the hinge side of the doors to increase the strength of the assembly although these have not been shown for clarity.

If the assembly is attacked such that one of the doors 14 is broken from its hinges, it will still be very difficult to remove the door because the loosened door will slide around on the adjacent barrier members 18 and locking blades 22 which, even though the door has been broken from its hinge, remain in the locked condition. The barrier members 18 and locking blades 22 interact with the other doors 14 and the frame to prevent the doors being pushed inwardly or pulled outwardly. As a result of the doors being slidable on the respective barrier members and locking blades, and also because the barrier members and locking blades substantially cover the boundaries between adjacent doors and the frames, it is very difficult to gain purchase on the assembly with a tool such as a crowbar because the doors merely slide relative to one another if they are broken from their hinges. Consequently, the multiple doors are interdependent which increases strength. It is therefore very difficult to break past the doors.

It should be understood that the security assembly could also be used with safes, drugs cabinets or any location where it is desirable to limit access to. Furthermore, a single door having barrier members extending around the door can be used if only one compartment needs protecting because the advantages provided by the barrier members apply equally to a single door or a plurality of doors.

Referring to FIGS. 1 to 3 and 12, each door 14 may comprise a respective access switch in the form of a button 15 and a respective lever (not shown). In order to activate the security assembly, a signal can be transmitted from a remote control room that enables the buttons 15 and levers to be used to open the doors. Alternatively, the security assembly can comprise a timer (not shown) that only enables the doors 14 to be opened during a specified time window. For example, the time window can coincide with a time during which security personnel will be present to refill the ATM. Furthermore, depressing the buttons 15 in a predetermined sequence could activate the security assembly. A control device 19 would determine whether the correct sequence has been entered and then activate the assembly. This provides the advantage that the assembly can be activated without any dedicated keys or other controls and therefore provides a concealed method of activating the security assembly because the buttons that are used to open the doors also act to activate the assembly.

Figure 12:
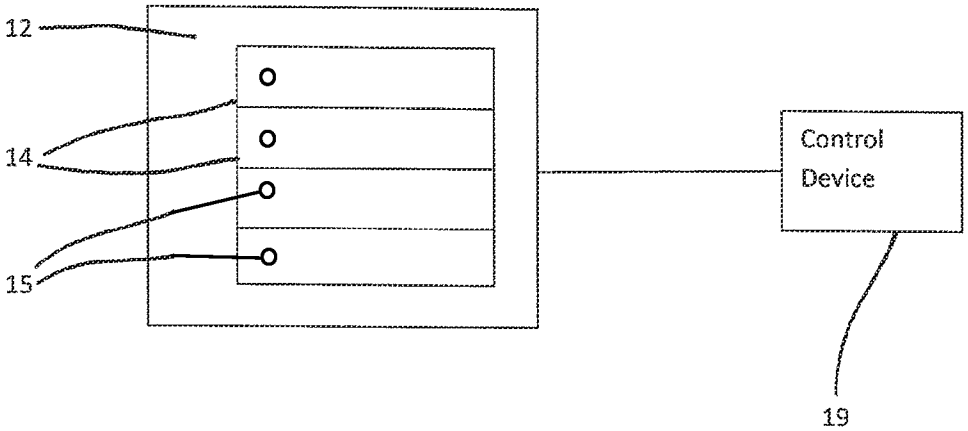
FIG. 12 is a schematic of a control apparatus embodying the present invention.
Figure 13:
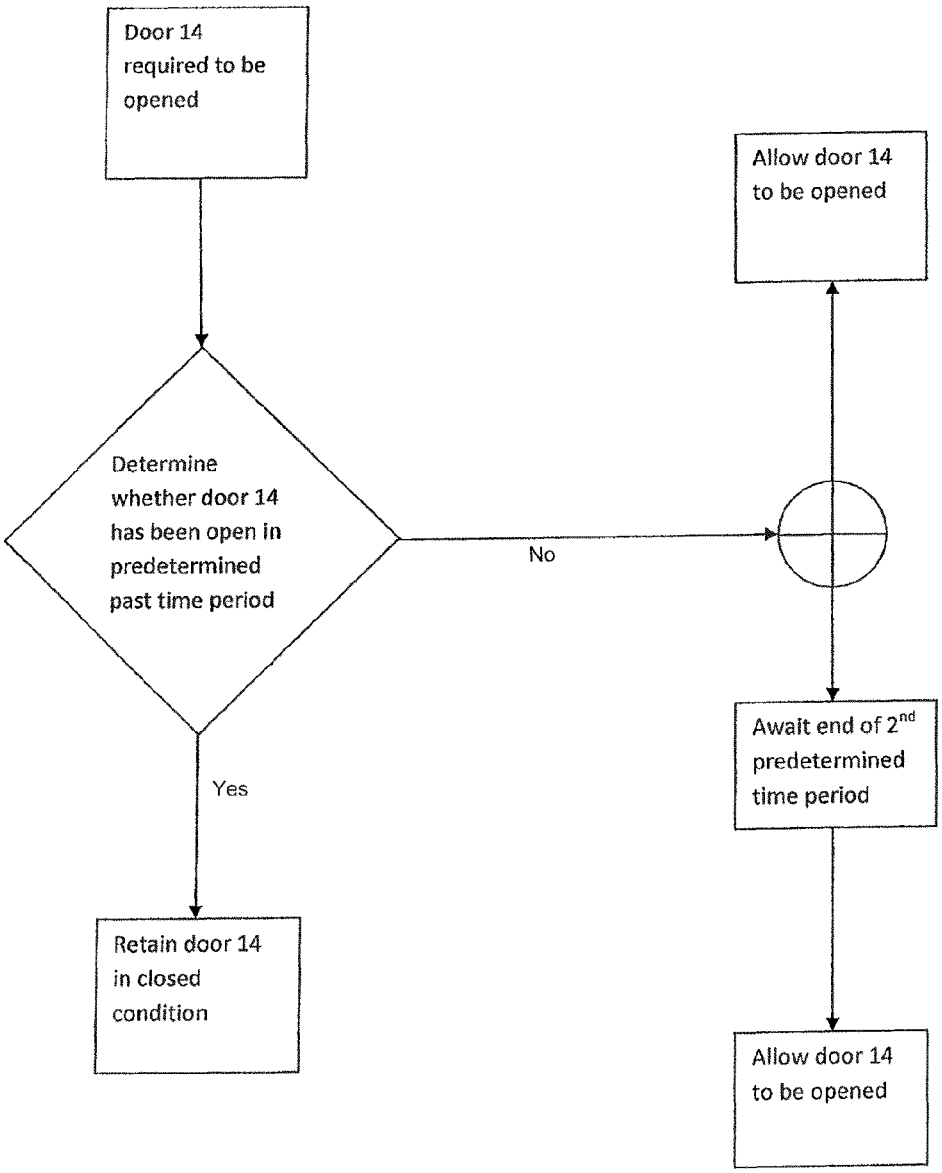
FIG. 13 is a flow chart of the method of controlling a security assembly embodying the present invention.

Referring to FIGS. 12 and 13, the security assembly also comprises a control device 19, which may comprise an electronic control means or could comprise a mechanical timing mechanism. When the security assembly has been activated, button 15 of one of the doors 14 is depressed. The control device 19 then automatically follows the following sequence of steps:

1. A determination is made whether the door 14 has been open during a predetermined first past time period, for example the past hour.
2. If the door has been open during the past hour, then the control device 19 does not allow the door to be opened. This is accomplished by the control device 19 not connecting the lever (not shown) to barrier members 18 such that movement of the lever does not retract the barrier members into the unlocked condition.
3. Or, if the door has not been open in the past hour, then the end of a predetermined second time period, for example 30 seconds is awaited and the lever (not shown) of the door is then connected to the respective barrier members 18 of the door allowing a user to move the lever and retract the barrier members to open the door.

It will be apparent to persons skilled in the art that the above process can be accomplished by both mechanical and electronic means. Also, use of a lever is entirely optional, as the button could be used to both activate the control means and also retract the barrier members.

The above process provides several advantages. Firstly, security staff refilling ATMs are generally attacked when the ATM will be nearly full, i.e. when three or four of the four cash cassettes have been refilled. If there is a one hour time delay from opening a door until which time the door can be re-opened, if the security staff are attacked when they are refilling the final cassette then thieves will only be able to access the final cassette. This will reduce the amount of cash available to the thieves making attacking the ATM less desirable. Furthermore, since the security staff have no control over which doors can be opened because the process of time delays is entirely automatic, then hostage situations will be prevented.

By awaiting the end of a second time period until the doors are able to be opened increases the time taken for thieves to gain access to the security assembly. For example, if the ATM comprises four cash cassettes and therefore four doors 14, four time periods of 30 seconds will be added to the time taken to open all of the doors. If the thieves have gained access to the rear of the ATM, the alarm of the bank or building in which the ATM is held will generally have been activated. Adding two minutes to the time taken for an attack under alarm conditions acts as a deterrent to thieves because they will know that the security services are likely to have been notified and may be en route to the site of the ATM.

It will be appreciated by persons skilled in the art that the above embodiments have been described by way of example only and not in any limitative sense, and that various alterations and modifications are possible without departure from the scope of the invention as defined by the appended claims.

What is claimed is:

1. A method of controlling a security assembly comprising a frame member and at least one door, the method comprising the steps of:

when said at least one door is required to move from a closed condition to an open condition, determining whether said at least one door has been in the open condition within a predetermined first past time period;

when said at least one door has not been in the open condition during said predetermined first past time period, allowing said at least one door to be opened; and when said at least one door has been in the open condition during said predetermined first past time period, retaining said at least one door in the closed condition.

2. A method according to claim 1, further comprising the step of when said at least one door has not been in the open condition during said predetermined first past time period, allowing said at least one door to be opened after awaiting the end of a predetermined second time period.

3. An apparatus comprising:

an electronic control device that is adapted to be coupled to a security assembly comprising at least one door, and when coupled to the security assembly is configured to automatically operate to:

receive a signal indicating that the door of the security assembly is required to move from a closed position to an open position;

in response to the receipt of the signal determine whether the door has been in the open position within a predetermined first past time period;

in response to determining that the door has not been in the open position within the predetermined first past time period, electronically control a locking mechanism of the security assembly to be placed in a second orientation that allows the door to be opened; and in response to determining that the door has been in the open position within the predetermined first past time period, electronically control the locking mechanism to be in a first orientation that locks the door in the closed position.

4. An apparatus according to claim 3, wherein the apparatus further comprises the security assembly which includes a plurality of doors and wherein each said door comprises a respective access switch, and wherein closing an access switch indicates to the control device that the corresponding door is required to move from the closed position to the open position.

5. An apparatus according to claim 4, wherein the apparatus has an inactive condition in which each said door cannot be opened and an active condition in which each said door can be opened, and wherein the active condition corresponds to said second orientation of said locking mechanism for each said door and is activated by closing the access switches of the plurality of doors in a predetermined sequence.

* * * * *